US005373976A

United States Patent [19]

Rancoule et al.

[11] Patent Number: 5,373,976

[45] Date of Patent: Dec. 20, 1994

[54] REFRACTORY ZIRCONIA MORTAR

[75] Inventors: Gilbert I. Rancoule, Monaca; Mark K. Fishler, Mahomet, both of Pa.

[73] Assignee: Vesuvius Crucible Company, Pittsburgh, Pa.

[21] Appl. No.: 48,669

[22] Filed: Apr. 16, 1993

[51] Int. Cl.[5] ..... B22D 41/32

[52] U.S. Cl. ..... 222/600; 222/597

[58] Field of Search ..... 222/600, 591, 597; 266/236; 501/105

[56] References Cited

U.S. PATENT DOCUMENTS

| | | | |
|---|---|---|---|
| 2,429,872 | 10/1947 | Downs | 106/65 |
| 3,102,037 | 8/1963 | Kimpel | 106/57 |
| 3,188,368 | 6/1965 | Stewart et al. | 264/56 |
| 3,304,187 | 2/1967 | Limes et al. | 106/58 |
| 3,519,447 | 7/1970 | Adams et al. | 106/57 |
| 3,730,744 | 5/1973 | Yavorsky | 106/57 |
| 3,782,980 | 1/1974 | Smith | 106/57 |
| 3,793,040 | 2/1974 | Burrows | 106/55 |
| 3,992,213 | 11/1976 | Desouches et al. | 106/57 |
| 4,111,711 | 9/1978 | Kiehl et al. | 106/97 |
| 4,119,472 | 10/1978 | Brashear, Jr. et al. | 106/57 |
| 4,179,046 | 12/1979 | Jeschke et al. | 222/600 |
| 4,222,782 | 9/1980 | Alliegro et al. | 106/57 |
| 4,308,067 | 12/1981 | Guigonis et al. | 501/105 |
| 5,002,909 | 3/1991 | Montino et al. | 501/105 |
| 5,032,555 | 7/1991 | Yamanis et al. | 501/105 |
| 5,039,644 | 8/1991 | Lachman et al. | 502/208 |
| 5,055,433 | 10/1991 | Niwa et al. | 501/105 |

FOREIGN PATENT DOCUMENTS

| | | | |
|---|---|---|---|
| 0773944 | 5/1957 | United Kingdom | 501/105 |
| 0718420 | 2/1980 | U.S.S.R. | 501/105 |

*Primary Examiner*—Scott Kastler

*Attorney, Agent, or Firm*—Webb Ziesenheim Bruening Logsdon Orkin & Hanson

[57] ABSTRACT

An erosion resistant refractory mortar composition is described which is suitable for bonding a zirconia insert in an alumina graphite plate of a sliding gate valve. The refractory mortar is made from a mix consisting of, in weight percent, about 50%-85% zirconia; about 15%-50% alumina; up to 5% chromium oxide; up to 6% phosphoric acid plus an effective amount of a binder. Sufficient water is added to provide proper plasticity to the mix.

12 Claims, 1 Drawing Sheet

REFRACTORY ZIRCONIA MORTAR

BACKGROUND OF THE INVENTION

The invention relates generally to mortar compositions and, more particularly, to a refractory mortar composition useful in joining fired refractory shapes in sliding gate valves. Sliding gate valves are used to control the flow of molten steel from a metallurgical vessel, such as a tundish, to a continuous casting mold or molds. A typical slide gate plate, as shown for example in U.S. Pat. No. 4,415,103 to Shapland et al., comprises a plurality of refractory plates, each having a teeming orifice therethrough. When one of the plates is moved out of vertical alignment with the others, the teeming orifices, likewise, move out of register, permitting the flow of molten steel to be selectively throttled between a fully opened to a fully closed condition.

Heretofore, in order to increase the erosion resistance of conventional carbon bonded alumina graphite slide gate plates, a pressed and fired insert of oxide bonded zirconia has been employed in the area surrounding the teeming orifice. The zirconia insert is conventionally cemented into a recessed region formed in a bearing surface of the alumina graphite plate using an alumina, phosphate bonded mortar. Both the zirconia insert and alumina graphite plate are usually tar impregnated prior to the mortar cementing step. The impregnated carbonaceous material sometimes causes bonding problems with conventional alumina mortar. It has also been observed that molten steel contacts the mortar joint during throttling and closing of the valve, causing erosion and corrosion of the alumina mortar and eventual liquid steel penetration of the joint. This problem naturally creates serious safety and maintenance concerns and also affects the overall economics of the continuous casting operation which depends upon long uninterrupted casting campaigns for maximum efficiencies.

The present invention is directed to an improved mortar composition which solves the problems heretofore encountered in joining a zirconia insert to an alumina graphite slide gate plate.

The refractory mortar of the present invention provides improved erosion and corrosion resistance to molten steel while also providing improved bonding adhesion between the carbon of the tar impregnated components than heretofore possible when utilizing conventional refractory cements or mortars.

In addition, the present invention provides a refractory mortar having improved thermal expansion characteristics resulting in better sealing of the joint between the zirconia insert and the alumina graphite slide gate plate during high temperature service.

SUMMARY OF THE INVENTION

The present invention is directed to a refractory mortar composition as well as to a slide gate plate having an insert cemented therein utilizing the novel mortar composition. Briefly stated, the refractory mortar of the invention is made from a mix comprising in weight per cent about 50%–85% zirconia, about 15%–50% alumina, optionally about 0.5%–5% chromium oxide, plus effective amounts of a binder, phosphoric acid and water. The powders and liquids are mixed thoroughly while the water addition is adjusted to achieve proper plasticity of the mortar. The zirconia mortar of the invention is applied by a trowel or spatula in a thin layer of about 1 mm to the joint area between a zirconia insert and an alumina graphite slide gate plate. The cemented plate is then preferably subjected to a low temperature drying treatment to develop the necessary green strength prior to service.

These, as well as other advantages and attributes of the invention, will become more apparent when reference is made to the appended drawings taken in conjunction with the following detailed description.

DETAILED DESCRIPTION OF THE INVENTION

Figure 1:
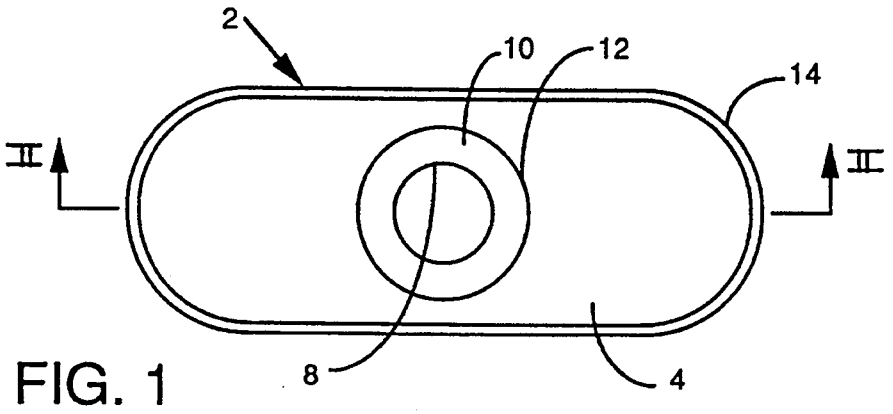
FIG. 1 is a plan view of a typical slide gate plate having a wear resistant insert cemented therein.
Figure 2:
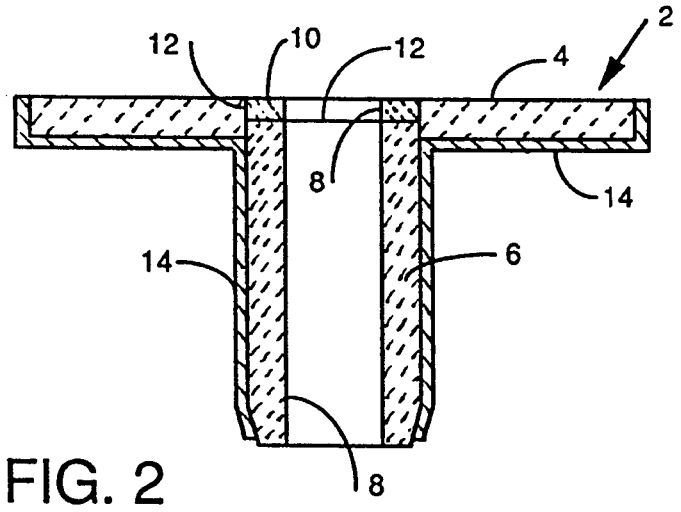
FIG. 2 is a cross sectional, side elevation view taken along line II—II of FIG. 1.

Referring now to the drawings, a typical slide gate plate and nozzle assembly, generally designated 2, is depicted in FIGS. 1 and 2. The assembly 2 is adapted for use as the lower plate in a tundish sliding gate valve to control the flow of molten steel into a continuous casting mold. Such sliding gate valves and nozzle gate assemblies are, in themselves, well-known in the steelmaking art.

The assembly 2 includes a flat plate portion 4 and a lower nozzle portion 6. A teeming orifice 8 axially extends through the nozzle 6 to permit molten steel to pass therethrough when the slide gate plate assembly 2 is positioned in register with a superjacent plate or plates. A ring-shaped insert 10 of zirconia refractory material is cemented to the plate 4 and nozzle 6 along mortar joints 12 using the refractory mortar of the present invention. The insert 10 also contains an upper portion of the teeming orifice 8 formed therein, axially aligned with the bore of the nozzle 6. A steel can or shell 14 is fitted around the outer surfaces of the assembly 2 in a known manner to protect the refractory elements 4 and 6.

The plate portion 4 of the slide gate assembly 2 is typically made from a carbon bonded alumina graphite refractory material which is fired and tar impregnated prior to use. The ceramic insert 10 is typically made from an oxide bonded zirconia refractory material which also has been pressed, fired and tar impregnated prior to use. The nozzle portion 6 is, likewise, made from a conventional carbon bonded alumina graphite refractory material which is pressed or cast and fired prior to use.

Figure 3:
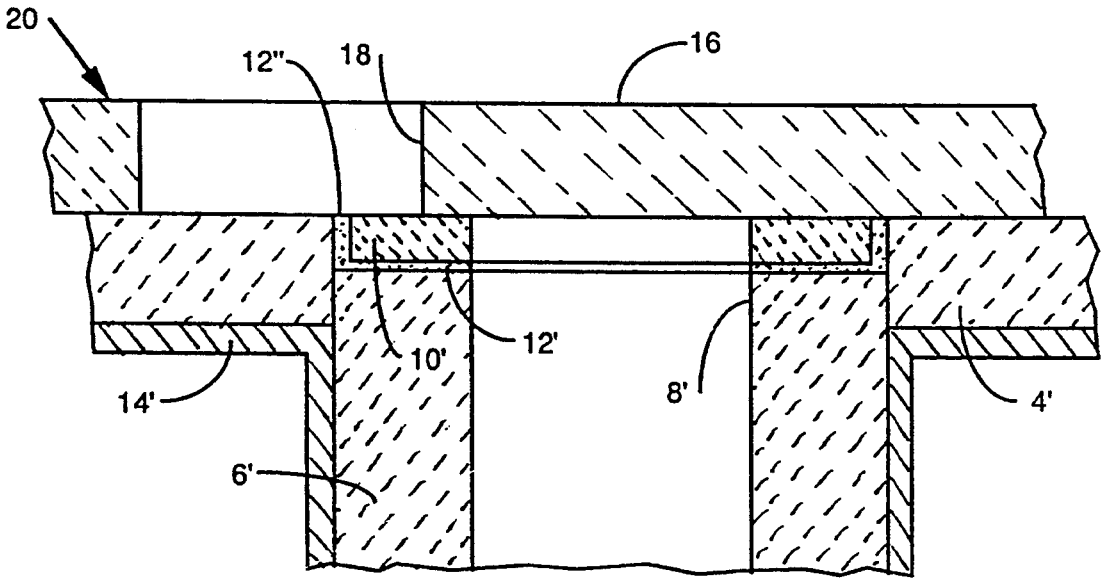
FIG. 3 is an enlarged, cross sectional, side view of a pair of slide gate plates in a shifted, closed position.

FIG. 3 depicts a pair of slide gate plates, generally designated 20, in a shifted or closed position. An upper slide gate plate 16 has a teeming orifice 18 therethrough which is laterally offset from a teeming orifice 8' in a lower slide gate plate 4'. The lower plate 4' has an insert 10' of oxide bonded zirconia cemented therein with the mortar of the present invention. It will be observed that a vertical edge portion 12'' of the mortar joint 12' is in direct contact with the molten steel present in the teeming orifice 18 when the plates 16 and 4' have been laterally shifted as shown in FIG. 3. In the case of prior art alumina mortars, the molten steel chemically attacks the mortar joint. The liquid steel will gradually leak through the pathway formed by the eroded mortar joints 12'', 12' to exit at the orifice 8'. The zirconia mortar of the present invention prevents such steel erosive and corrosive chemical attack of the mortar joints 12', 12".

The refractory mortar of the invention has a preferred mix formulation of the following dry constituents, in weight per cent:

| | |
|---|---|
| Zirconia ($ZrO_2$) | 45%-85% |
| Alumina ($Al_2O_3$) | 15%-50% |
| Chromia ($Cr_2O_3$) | 0.5%-5% |
| plus effective amounts of the following: | |
| Phosphoric acid ($H_3PO_4$) | |
| binder | |
| water | |

In a laboratory sized batch having a total dry weight of 1 kg. comprising the zirconia, alumina and chromia powders, about 50 grams (5 wt %) of phosphoric acid is added plus about 20 grams (2 wt %) of a starch binder in the form of dextrine may also be added. About 65 cc of water is added to the dry mixture, which is sufficient to make a paste-like cement having the proper plasticity to fill a 1 mm joint. Mixing of all ingredients is carried out in a known Hobart brand mixer to achieve a homogeneous composition as well as the proper plasticity. The mortar, after application, may be allowed to set in air and/or it may be dried at about 110° F. for several hours to drive off the water constituent.

In order to determine the effect of particle size and binder employed in the mortar of the invention, laboratory size mixes were formulated according to Table I.

TABLE I

| Materials: | C-1 | C-2 | C-3 |
|---|---|---|---|
| Zirconia* | | | |
| −100 mesh | 500 g | 500 g | — |
| −325 mesh | — | — | 500 g |
| Alumina | | | |
| (1 μm) - fine, high activity | 450 g | 200 g | 200 g |
| −325 mesh - tabular | — | 250 g | 250 g |
| Chromic Oxide | 50 g | 50 g | 50 g |
| Dextrine binder | — | 20 g | — |
| Phosphoric Acid | 50 g | 50 g | 50 g |
| Water | 78.5 g | 78.5 g | 128.5 g |

*calcia stabilized $ZrO_2$

Corrosion bars were prepared by making flat bars of pressed and fired carbon impregnated zirconia and pressed and fired alumina refractory materials. Each corrosion test sample comprised a zirconia bar and an alumina bar cemented together along their flat surfaces using mortar samples C-1, C-2, C-3 and conventional alumina mortar. The corrosion bars were submerged in a molten bath of steel and rotated therein. The comparative test indicated that the most corrosion resistant mortar was that of Mix No. C-2.

A larger batch made according to Mix No. C-2 was formulated as reported in Table II below.

TABLE II

| Material | Weight (gm) | dry wt % | wet wt % |
|---|---|---|---|
| −100 mesh $ZrO_2$ (CaO stabilized) | 2,275.0 | 50% | 43.7% |
| high activity $Al_2O_3$ | 910.0 | 204 | 17.5% |
| tabular $Al_2O_3$ | 1,137.5 | 25% | 21.85% |
| $Cr_2O_3$ | 227.5 | 5% | 4.4% |
| Dextrine binder | 91.0 | — | 1.7% |
| $H_3PO_4$ | 227.5 | — | 4.4% |
| $H_2O$ | 337.1 | — | 6.5% |

A pressed and fired carbon impregnated zirconia insert 10 was cemented in a carbon impregnated alumina plate 4 using the mortar formulated according to Table II applied in the mortar joint 12. The slide gate plate 2 was evaluated under actual steelmaking conditions.

The mortar of the invention was found to resist the corrosive effects of steel to a much greater extent than the conventional alumina mortar.

We have also observed that the zirconia mortar of the invention has a higher rate of thermal expansion than the prior alumina mortars which provides an improved mortar joint 12 between the zirconia insert 10 and plate 4.

Various modifications may be made to the mix formulation without departing from the instant invention. We have found that medium sized zirconia grain (−100 mesh) may be substituted wholly or partially for the tabular alumina grain (−325 mesh) since the tabular alumina is non-reactive, as opposed to the fine, high surface, area 1 μm sized alumina. The fine alumina powder constituent is reactive and is necessary in the composition. The $Cr_2O_3$ content may be decreased in favor of a like amount of a spinel/MgO constituent which will combine with the zirconia to improve erosion and corrosion resistance.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention which is to be given the full breadth of the appended claims and any and all equivalents thereof.

What is claimed is:

1. A plate assembly for use in a slide gate valve for controlling the flow of molten steel, from a metallurgical vessel, said plate assembly comprising:
   - a refractory plate having a cut out portion formed therein;
   - a refractory insert fitted into the cut out portion of the refractory plate; and
   - a refractory mortar applied in a joint area between the refractory insert and plate, said mortar having a dry composition consisting of in per cent by weight about 45%-85% zirconia; about 15%-50% alumina comprising a mixture of a high activity alumina and a tabular alumina; and about 0%-5% chromium oxide.

2. The plate assembly of claim 1 wherein the refractory plate is an alumina containing material and the refractory insert is an oxide bonded zirconia material.

3. The plate assembly of claim 2 wherein the plate and insert are tar impregnated.

4. The plate assembly of claim 1 wherein the zirconia of the refractory mortar is stabilized with calcia and has a particle size of −100 mesh.

5. The plate assembly of claim 1 wherein the alumina constituent of the mortar consists of at least about 25% of a high surface area alumina having a particle size of no more than 1 micron.

6. The plate assembly of claim 5 wherein the alumina constituent of the mortar also contains a tabular alumina having a particle size of −325 mesh.

7. A plate assembly for use in a slide gate valve for controlling the flow of steel from a metallurgical vessel comprising, a plate formed of alumina containing refractory material having a cut out portion formed therein;

an insert having a steel teeming orifice formed therein, said insert formed of an oxide bonded zirconia refractory material and fitted into the cut out portion of said plate; and a refractory mortar applied in a joint area between the refractory insert and plate, said mortar having a dry composition consisting of in per cent by weight about 45%-85% zirconia; about 15%-50% alumina comprising a mixture of a high activity alumina and a tabular alumina; and about 0%-5% chromium oxide.

8. The plate assembly of claim 7 wherein the zirconia of the refractory mortar is stabilized with calcia and has a particle size of −100 mesh.

9. The plate assembly of claim 7 wherein the alumina constituent of the mortar consists of at least about 25% of a high surface area alumina having a particle size of no more than 1 micron.

10. The plate assembly of claim 9 wherein the alumina constituent of the mortar also contains a tabular alumina having a particle size of −325 mesh.

11. A plate assembly for use in a slide gate valve for controlling the flow of molten steel, from a metallurgical vessel, said plate assembly comprising:

a refractory plate having a cut out portion formed therein;

a refractory insert fitted into the cut out portion of the refractory plate: and a refractory mortar applied in a joint area between the refractory insert and plate, said mortar having a dry composition consisting of in per cent by weight about 45%-85% zirconia; about 15%-50% alumina; and about 0%-5% chromium oxide; wherein said alumina constituent consists of at least about 25% of a high surface area alumina having a particle size of no more than 1 micron, and wherein the alumina constituent also contains a tabular alumina having a particle size of −325 mesh.

12. A plate assembly for use in a slide gate valve for controlling the flow of steel from a metallurgical vessel comprising:

a plate formed of alumina containing refractory material having a cut out portion formed therein;

an insert having a steel teeming orifice formed therein, said insert formed of an oxide bonded zirconia refractory material and fitted into the cut out portion of said plate; and a refractory mortar applied in a joint area between the refractory insert and plate, said mortar having a dry composition consisting of in per cent by weight above 45%-85% zirconia; about 15%-50% alumina; and about 0%-5% chromium oxide; wherein the alumina constituent of the mortar consists of at least about 25% of a high surface area alumina having a particle size of no more than 1 micron, and wherein the alumina constituent of the mortar also contains a tabular alumina having a particle size of −325 mesh.

* * * * *

UNITED STATES PATENT AND TRADEMARK OFFICE

CERTIFICATE OF CORRECTION

PATENT NO. : 5,373,976

DATED : December 20, 1994

INVENTOR(S) : Gilbert I. Rancoule and Mark K. Fishler

It is certified that error appears in the above-indentified patent and that said Letters Patent is hereby corrected as shown below:

Title page, item [75], Inventors, "Gilbert I. Rancoule, Monaca; Mark K. Fishler, Mahomet, both of Pa." should read --Gilbert I. Rancoule, Monaca, Pa.; Mark K. Fishler, Mahomet, Il.--.

Table II, under dry wt%, Column 3 Line 61, "204" should read --20%--

Claim 11 Line 31 Column 5 "plate:" should read --plate;--.

Claim 12 Line 23 Column 6 "above" should read --about--.

Signed and Sealed this

Twenty-first Day of February, 1995

*Attest:*

Bruce Lehman

BRUCE LEHMAN

*Attesting Officer*

*Commissioner of Patents and Trademarks*